US008845395B2

(12) United States Patent
Borucki et al.

(10) Patent No.: US 8,845,395 B2
(45) Date of Patent: Sep. 30, 2014

(54) METHOD AND DEVICE FOR THE INJECTION OF CMP SLURRY

(75) Inventors: Leonard John Borucki, Mesa, AZ (US); Yasa Adi Sampurno, Tucson, AZ (US); Ara Philipossian, Tucson, AZ (US)

(73) Assignee: Araca Inc., Tucson, AZ (US)

( * ) Notice: Subject to any disclaimer, the term of this patent is extended or adjusted under 35 U.S.C. 154(b) by 262 days.

(21) Appl. No.: 13/466,641

(22) Filed: May 8, 2012

(65) Prior Publication Data

US 2012/0220206 A1 Aug. 30, 2012

Related U.S. Application Data

(63) Continuation-in-part of application No. 12/262,579, filed on Oct. 31, 2008, now Pat. No. 8,197,306, and a continuation-in-part of application No. PCT/US2010/060801, filed on Dec. 16, 2010.

(51) Int. Cl.

| | |
|---|---|
| ***B24B 1/00*** | (2006.01) |
| ***B24B 37/04*** | (2012.01) |
| ***B24B 57/02*** | (2006.01) |

(52) U.S. Cl.

CPC ..... *B24B 37/04* (2013.01); *B24B 57/02* (2013.01)

USPC ..... 451/60; 451/41; 451/255; 451/444

(58) Field of Classification Search

USPC ..... 451/41, 60, 285, 444

See application file for complete search history.

(56) References Cited

U.S. PATENT DOCUMENTS

| | | | |
|---|---|---|---|
| 3,342,652 | A | 9/1967 | Reisman et al. |
| 4,549,374 | A | 10/1985 | Basi et al. |
| 4,910,155 | A | 3/1990 | Cote et al. |
| 5,216,843 | A | 6/1993 | Breivogel et al. |

(Continued)

FOREIGN PATENT DOCUMENTS

| | | |
|---|---|---|
| JP | 11-114811 | 4/1999 |
| JP | 2002-217146 | 8/2002 |

(Continued)

OTHER PUBLICATIONS

PCT/US2010/034975 International Search Report dated Jan. 26, 2011.

(Continued)

*Primary Examiner* — Lee D Wilson
*Assistant Examiner* — Shantese McDonald
(74) *Attorney, Agent, or Firm* — Schmeiser, Olsen & Watts LLP

(57) ABSTRACT

Disclosed is an apparatus for injecting slurry onto the polishing pad surface of a chemical mechanical polishing (CMP) tool. The disclosed apparatus includes a rectilinear shaped injector bottom, where multiple slots are created in the top surface of the injector bottom, allowing the injector bottom to flex and to conform to the polishing pad profile. CMP slurry or components thereof are introduced through one or more top surface openings, travel through the injector body, and exit through a slit or bottom surface opening. The slurry is spread into a thin film by the injector, and is introduced at the gap between the surface of the polishing pad and the wafer, along the leading edge of the wafer, in quantities small enough that all or most of the slurry is introduced between the wafer and the polishing pad.

15 Claims, 6 Drawing Sheets

(56) References Cited

U.S. PATENT DOCUMENTS

| | | | | |
|---|---|---|---|---|
| 5,403,228 | A | 4/1995 | Pasch | |
| 5,554,064 | A | 9/1996 | Breivogel et al. | |
| 5,709,593 | A | 1/1998 | Guthrie et al. | |
| 5,873,769 | A | 2/1999 | Chiou et al. | |
| 5,964,413 | A | 10/1999 | Mok | |
| 5,997,392 | A * | 12/1999 | Chamberlin et al. | 451/446 |
| 6,019,671 | A | 2/2000 | Shendon | |
| 6,135,868 | A | 10/2000 | Brown et al. | |
| 6,193,587 | B1 | 2/2001 | Lin et al. | |
| 6,283,840 | B1 | 9/2001 | Huey | |
| 6,284,092 | B1 * | 9/2001 | Manfredi | 156/345.12 |
| 6,312,558 | B2 | 11/2001 | Moore | |
| 6,336,850 | B1 | 1/2002 | Wada et al. | |
| 6,347,979 | B1 | 2/2002 | Drill | |
| 6,398,627 | B1 | 6/2002 | Chiou et al. | |
| 6,429,131 | B2 | 8/2002 | Lin et al. | |
| 6,500,054 | B1 | 12/2002 | Ma et al. | |
| 6,500,055 | B1 | 12/2002 | Adams et al. | |
| 6,623,343 | B2 | 9/2003 | Kajiwara et al. | |
| 6,679,765 | B2 * | 1/2004 | Tung et al. | 451/60 |
| 6,686,284 | B2 | 2/2004 | Chung et al. | |
| 6,764,387 | B1 | 7/2004 | Chen | |
| 6,887,132 | B2 | 5/2005 | Kajiwara et al. | |
| 6,929,533 | B2 | 8/2005 | Chang | |
| 6,945,857 | B1 | 9/2005 | Doan et al. | |
| 6,976,902 | B2 | 12/2005 | Koo et al. | |
| 6,984,166 | B2 | 1/2006 | Maury et al. | |
| 7,008,302 | B2 | 3/2006 | Wu et al. | |
| 7,021,099 | B2 | 4/2006 | Bennett et al. | |
| 7,101,251 | B2 | 9/2006 | Swedek et al. | |
| 7,175,510 | B2 | 2/2007 | Skocypec et al. | |
| 7,201,634 | B1 | 4/2007 | Naujok et al. | |
| 7,857,683 | B2 | 12/2010 | Burns et al. | |
| 7,980,922 | B2 | 7/2011 | Kiesel et al. | |
| 2002/0144371 | A1 | 10/2002 | Piombini | |
| 2002/0173240 | A1 | 11/2002 | Wang et al. | |
| 2003/0068959 | A1 * | 4/2003 | Kajiwara et al. | 451/41 |
| 2007/0049170 | A1 | 3/2007 | Han | |
| 2007/0224920 | A1 | 9/2007 | Nakagawa et al. | |
| 2007/0281592 | A1 | 12/2007 | Benner | |
| 2008/0113513 | A1 | 5/2008 | Baum | |
| 2010/0112905 | A1 | 5/2010 | Borucki et al. | |
| 2010/0216373 | A1 | 8/2010 | Borucki et al. | |

FOREIGN PATENT DOCUMENTS

| | | | |
|---|---|---|---|
| JP | 2008263120 | A | 10/2008 |
| KR | 10-2000-0000583 | | 1/2000 |
| KR | 20000000583 | A | 1/2000 |
| KR | 100814069 | | 3/2008 |
| KR | 1020090055414 | | 6/2009 |
| KR | 1020090090788 | | 8/2009 |
| WO | 2004073055 | | 8/2004 |

OTHER PUBLICATIONS

PCT/US2010/034988 International Search Report dated Jan. 28, 2011.

PCT/US2010/060330 International Search Report dated Sep. 15, 2011.

PCT/US2010/060801 International Search Report dated Sep. 16, 2011.

PCT/US2010/060801 International patent application filed Dec. 16, 2010.

Borucki, L., Method for the Injection of CMP Slurry, U.S. Appl. No. 12/392,676, filed Feb. 25, 2009, US Patent Application.

Borucki, L., Method and Device for the Injection of CMP Slurry, U.S. Appl. No. 12/262,579, filed Oct. 31, 2008, US Patent Application.

Borucki, L., Method and Apparatus for Chemical-Mechanical Planarization, U.S. Appl. No. 13/225,086, filed Sep. 2, 2011, US Patent Application.

PCT International Search Report, App No. PCT/US2010/060801, mailing date Sep. 16, 2011, International filing date Dec 16, 2010.

* cited by examiner

METHOD AND DEVICE FOR THE INJECTION OF CMP SLURRY

CROSS REFERENCE TO RELATED APPLICATIONS

This application is a continuation-in-part of the earlier U.S. Utility patent application to Borucki, et al entitled "Method and Device for the Injection of CMP Slurry," Ser. No. 12/262,579, filed Oct. 31, 2008, the disclosure of which is hereby incorporated entirely herein by reference. This application is also a continuation-in-part of the earlier Patent Cooperation Treaty Application to Araca entitled "Method and Device for the Injection of CMP Slurry," international application number PCT/US2010/060801, filed Dec. 16, 2010, the disclosure of which is hereby incorporated entirely herein by reference.

BACKGROUND OF THE INVENTION

1. Technical Field

This invention relates generally to chemical mechanical polishing (CMP) tools and in particular to a device for injecting slurry onto the polishing pad of a chemical mechanical polishing tool.

2. State of the Art

Chemical Mechanical Polishing (CMP) slurry, together with polishing pads and diamond conditioner disks, form the key components of the equipment used to carry out CMP processes in recent years. These polishing pads and diamond conditioner disks have been produced and marketed by several vendors to standards of reliable quality and effectiveness. The function of the polishing pad is to cut away and polish the wafer surface in conjunction with the slurry. As they accomplish this function, the polishing pads themselves become smooth and lose effectiveness in their capacity to polish the wafer surface. The function of the diamond conditioner disks, the surface facing the polishing pad of which is covered with small embedded diamonds or other hard substance, is to cut into and roughen the polishing pad surface during polishing so that it is continually being roughened as the wafer smoothes it. This way the effectiveness of the polishing pad is maintained relatively constant. The function of the slurry is to deliver continuously the mechanical abrasive particles and chemical components to the surface of the wafer and to provide a means of removing reaction products and wafer debris from the polishing surface. There are several varieties of slurry of varying effectiveness and properties known to the art. At present, for the most common type of CMP tool, the rotary polisher, slurry is applied at a constant flow rate onto the rotating polishing pad using a simple delivery tube, nozzle or spray bar. Fresh slurry flows away from the application point(s) under the influence of gravity and centripetal acceleration and becomes mixed with used slurry or slurry that has passed between the polishing pad and wafer and been involved in polishing. Old slurry, besides being chemically "spent", additionally contains the debris from wafer, conditioner and pad. If the old slurry reenters the gap between the wafer and the polishing pad and is exposed to the wafer surface, this can lead to increases in contamination and defectivity. It is therefore important to remove the debris of polishing, and by extension used slurry, from the polishing pad quickly after it is generated and to the greatest extent possible not reintroduce it under the wafer. Thus there is a need for a device for injecting slurry onto the polishing pad surface, which also removes old slurry and does not allow the old slurry to be mixed with the new slurry.

DISCLOSURE OF THE INVENTION

The disclosed invention relates to chemical mechanical polishing tools and in particular to a device for injecting slurry onto the polishing pad of a chemical mechanical polishing tool Disclosed in an injector device for injecting slurry onto a polishing pad of a chemical mechanical polishing tool. The injector device includes an injector bottom. The injector bottom includes a top surface, where the top surface includes one or more than one top surface opening. The injector bottom includes a bottom surface, where the bottom surface includes one or more than one bottom surface opening. The one or more than one bottom surface opening is in fluid communication with the one or more than one top surface opening. The injector bottom also includes a leading edge, a trailing edge, and a groove formed in the bottom surface, where the groove extends along a length of the injector bottom between the leading edge and the trailing edge. A CMP slurry introduced through the one or more than one top surface opening travels through the injector bottom and exits the injector device through the one or more than one bottom surface opening onto the polishing pad top surface. In some embodiments the leading edge is straight. In some embodiments the trailing edge is straight.

In some embodiments the groove includes a leading sidewall, where the leading sidewall is parallel to the leading edge. In some embodiments the groove includes a trailing sidewall, where the trailing sidewall is parallel to the trailing edge. In some embodiments the bottom surface includes a slit extending along the length of the injector bottom between the trailing sidewall and the trailing edge. In some embodiments the bottom surface openings are located in the slit. In some embodiments the top surface further comprises a plurality of slots formed in the top surface, where the slots run from the leading edge to the trailing edge, and where a depth of each of the plurality of slots extends from the top surface into the injector bottom, and where the depth of each of the plurality of slots does not extend all the way to the bottom surface. In some embodiments the injector bottom is rectilinear shaped. In some embodiments the bottom surface rests on the polishing pad.

Disclosed is an injector device for injecting slurry onto a polishing pad of a chemical mechanical polishing tool, where the injector device includes a rectilinear shaped injector bottom. The injector bottom includes a top surface, where the top surface comprises one or more than one top surface opening. The injector bottom includes a bottom surface, where the bottom surface includes one or more than one slit, and where the one or more than one slit is in fluid communication with the one or more than one top surface opening. The injector bottom also includes a leading edge and a trailing edge. In some embodiments the leading edge is straight. In some embodiments the trailing edge is straight. A CMP slurry introduced through the one or more than one top surface opening travels through the injector bottom and exits the injector bottom through the one or more than one slit onto the polishing pad top surface. In some embodiments the bottom surface rests on a top surface of the polishing pad.

In some embodiments the injector device has a center of gravity between the leading edge and the trailing edge, where the distance from the leading edge to the center of gravity is larger than the distance from the center of gravity to the trailing edge. In some embodiments the injector device includes a first set of weights positioned on top of the top surface. In some embodiments the injector device includes a second set of weights positioned on top of the first set of weights. In some embodiments the injector top surface includes one or more than one slot formed in the injector top surface, where the one or more than one slot runs from the leading edge to the trailing edge, where a depth of each of the one or more than one slot extends into the injector bottom from the top surface, and where the depth of each of the one or more than one slot does not extend all the way to the injector bottom surface. In some embodiments the injector device includes a groove formed in the bottom surface running along the length of the injector bottom, where the groove is located between the leading edge and the trailing edge.

Disclosed is an injector device for injecting slurry onto a polishing pad of a chemical mechanical polishing (CMP) tool, where the injector device includes a rectilinear shaped injector bottom. The injector bottom includes a top surface, where the top surface includes one or more than one top surface opening. The injector bottom includes a bottom surface, where the bottom surface includes one or more than one bottom surface opening. The one or more than one bottom surface opening is in fluid communication with the one or more than one top surface opening. The injector bottom includes a leading edge, and a trailing edge. In some embodiments the leading edge is straight. In some embodiments the trailing edge is straight. The injector bottom also includes one or more than one slot formed in the top surface, where a depth of each of the one or more than one slots extends from the top surface into the injector bottom, and where the depth of each of the one or more than one slots does not extend to the bottom surface. CMP slurry introduced through the one or more than one top surface opening travels through the injector bottom and exits the injector device through the one or more than one bottom surface opening onto the polishing pad top surface. In some embodiments the bottom surface rests on a top surface of the polishing pad. In some embodiments the one or more than one bottom surface opening forms a slit in the bottom surface. In some embodiments the slit runs parallel to the injector trailing edge. In some embodiments the leading edge is chamfered. In some embodiments the injector bottom includes a groove formed in the bottom surface, running along the length of the injector bottom, wherein the groove is located between the leading edge and the trailing edge.

The foregoing and other features and advantages of the disclosed invention will be apparent from the following more detailed description of the particular embodiments of the invention, as illustrated in the accompanying drawings.

DETAILED DESCRIPTION OF EMBODIMENTS OF THE INVENTION

Figure 1:
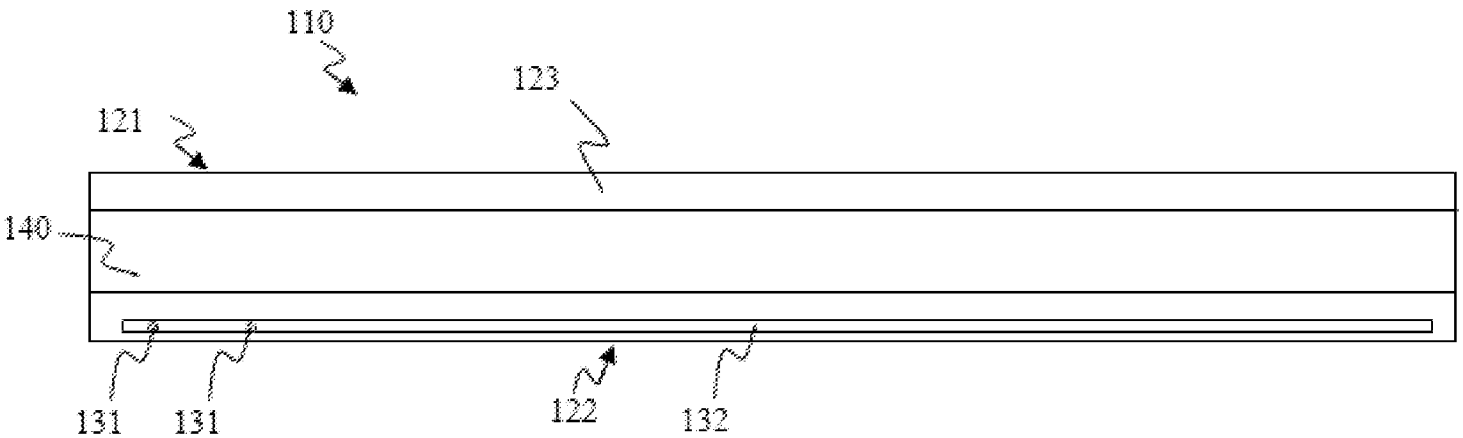
FIG. 1 shows a bottom view of injector 110 according to invention.

Chemical Mechanical Polishing (CMP) slurry, together with polishing pads and diamond conditioner disks, form the key components of the equipment used to carry out CMP processes in recent years. These polishing pads and diamond conditioner disks have been produced and marketed by several vendors to standards of reliable quality and effectiveness. The function of the polishing pad is to cut away and polish the wafer surface in conjunction with the slurry. As they accomplish this function, the polishing pads themselves become smooth and lose effectiveness in their capacity to polish the wafer surface. The function of the diamond conditioner disks, the surface facing the polishing pad of which is covered with small embedded diamonds or other hard substance, is to cut into and roughen the polishing pad surface during polishing so that it is continually being roughened as the wafer smoothes it. In this way the effectiveness of the polishing pad remains constant. The function of the slurry is to deliver continuously the mechanical abrasive particles and chemical components to the surface of the wafer and to provide a means of removing reaction products and wafer debris from the polishing surface. There are several varieties of slurry of varying effectiveness and properties known to the art. At present, for the most common type of CMP tool, the rotary polisher, slurry is applied at a constant flow rate onto the rotating polishing pad using a simple delivery tube, nozzle or spray bar. Fresh slurry flows away from the application point(s) under the influence of gravity and centripetal acceleration and becomes mixed with used slurry, or slurry that has passed between the polishing pad and wafer and been involved in polishing. Old slurry, besides being chemically "spent", additionally contains the debris from the wafer, conditioner and pad. If the old slurry reenters the gap between the wafer and polishing pad and is exposed to the wafer surface, this can lead to increases in contamination and defectivity. It is therefore important to remove the debris of polishing, and by extension used slurry, from the polishing pad quickly after it is generated and to the greatest extent possible not reintroduce it under the wafer.

Eventually, the rotation of the pad brings the slurry into contact with the leading edge of the wafer, where it forms a bow wave. Some of the fresh slurry at this point is advected into the narrow 10 to 25 micron gap between the wafer and polishing pad and is utilized for polishing. The gap exists because the surface of the pad is rough, the surface of the wafer is relatively smooth, and the wafer contacts only the high points of the pad surface. However, most of the fresh slurry remains in the bow wave and is carried to the edge of the pad by the combined rotation of the polishing head and pad. The slurry is then lost over the edge of the pad. Thus, actual slurry utilization, the percentage of new slurry applied that enters the gap between the rough pad surface and the wafer of total slurry applied, is universally quite low in such rotary CMP tools. This is a significant problem because slurry consumption and waste disposal account for a large share of the cost of ownership and operation of a CMP tool.

An additional negative influence on polishing removal rate and uniformity arises because when wafers are polished it is the practice in the art to wash used slurry off between wafers by application of deionized water to the pad, typically to the center of the pad. The time between removing one wafer and replacing it with a second is short and invariably a large quantity of water remains on the pad when polishing of the new wafer begins. This water is not uniformly distributed and as a result it dilutes the newly added slurry in a non-uniform way causing both general decrease in removal rate by the diluted slurry and lack of uniformity in removal rate due to variations in slurry concentration on different parts of the pad. Since this effect lasts several seconds, it can exert a significant negative effect on anywhere from 25 percent to 50 percent of the time during which the wafer is polished, resulting in a significant and costly reduction in process effectiveness and product quality.

To facilitate the advection or entry of the slurry under the wafer, the practitioners of previous methods have used grooves in the CMP pad. This was effective in making sure that some slurry reached the pad-wafer interface, but still allowed most of the slurry to be cast off of the pad without ever having been used. Slurry is expensive and devices, equipment and procedures for providing and removing large amounts of slurry must be included in the CMP process, which both complicates and encumbers that process. Presently there is no effective method available for substantially reducing the amount of slurry used or making sure that most of the slurry introduced to the pad during CMP is actually introduced between the pad and the wafer and utilized as intended before being cast off of the pad.

Methods to solve this problem to date have, as stated above, consisted of placing grooves in the surface of the CMP pad to conduct some portion of the slurry under the wafer during CMP polishing. In U.S. Pat. No. 5,216,843 (Breivogel et al filing date 24 Sep. 1992 hereby incorporated by reference) "an apparatus for polishing a thin film" . . . "said apparatus comprising" . . . "a pad covering said table, said pad having an upper surface into which have been formed a plurality of preformed grooves, said preformed grooves facilitating the polishing process by creating a corresponding plurality of point contacts at the pad/substrate interface." and a "means for providing a plurality of micro channel grooves into said upper surface of said pad while polishing said substrate wherein said microchannel grooves aid in facilitating said polishing process by channeling said slurry between said substrate and said pad." Still in U.S. Pat. No. 7,175,510 (Skyopec et al. filing date 19 Apr. 2005 hereby incorporated by reference) a method of polishing wherein "The polishing pad has grooves that channels (sic) slurry between the wafer and polishing pad and rids excess material from the wafer, allowing an efficient polishing of the surface of the wafer." is described. Even as recently as Skyopec et al the preferred method for maximizing the amount of slurry that was introduced between the pad and the wafer was preparation of the grooves and the efforts of practitioners of the art were limited to ensuring that these "micro-channels" were regenerated or maintained in a suitable fashion.

In US 2007 0224920 (hereby incorporated by reference) these grooves are enhanced by holes in the pad made in sizes and shapes appropriate to optimize the amount of slurry conducted under the wafer by the grooves. However this does not solve the basic problem of waste of new slurry due to slurry accumulation in the bow wave.

Moreover, Novellus Systems, Inc. has addressed the slurry utilization problem by means of orbital polishers (U.S. Pat. No. 6,500,055 hereby incorporated by reference) in which the slurry is injected through the polishing pad directly under the wafer (U.S. Pat. No. 5,554,064 hereby incorporated by reference). This guarantees high slurry utilization but requires a complex platen and custom pad to accommodate the slurry distribution system and a specialized polishing tool to take advantage of the injection method. Similarly in US 20070281592 (hereby incorporated by reference) slurries and other conditioning chemicals are introduced and removed through apertures in the diamond conditioning disk for the purpose of facilitating multistep CMP processes but this is not intended to and does not effectively improve the utilization of slurry by directing a larger fraction between the wafer and the CMP pad.

Earlier practice includes U.S. Pat. No. 5,964,413 (hereby incorporated by reference), which teaches an Apparatus for dispensing slurry. This is a device for spraying slurry on to the pad rather than pumping it in specific positions at the pad wafer interface and does not provide the desirable benefits sought by the disclosed invention. In addition, U.S. Pat. No. 6,929,533, (hereby incorporated by reference) teaches methods for enhancing within-wafer CMP uniformity. This patent describes methods for enhancing the polish rate uniformity of rotary and linear polishers using slurry dispense bars with multiple nozzles to distribute the slurry over the entire wafer track. The slurry dispense bars sit above the pad and do not contact it. This method when compared with the disclosed invention lacks the effect of the creation of a layer of slurry with the same thickness as the wafer-pad gap which allows significant amounts of the new slurry to be advected under the pad the first time.

U.S. Pat. No. 6,283,840 (hereby incorporated by reference) teaches a cleaning and slurry distribution system assembly for use in chemical mechanical polishing apparatus. This apparatus has "an outlet to distribute slurry to the enclosed region to form a reservoir of slurry in the enclosed region, wherein the slurry is distributed to a region not enclosed by the retainer by traveling between the polishing surface and the lower surface of the retainer." However, the application of the slurry to specific land areas where it is needed is not taught and in fact most slurry is lost through grooves between the land areas which generally exceed the land areas in cross sectional area between the wafer and the polishing pad. This apparatus also fails to teach or accomplish control over flow as a function of radius from the center of the polishing pad and there is no teaching or reported effect of separation of the old spent slurry, dilution water or polishing wastes from the newly applied slurry. The main function that the apparatus accomplishes is to keep spray from the slurry or from cleaning agents from depositing on the polisher, where the residue can become a source of defect-causing contamination. This is mentioned several times in the description. The background mentions reducing slurry consumption in passing in the last paragraph, but the patent contains no teaching that the apparatus accomplishes this or indeed how it would be accomplished. U.S. Pat. No. 5,997,392 (hereby incorporated by reference), teaches Slurry injection technique for chemical-mechanical polishing. The slurry application method involves spraying the slurry onto the pad under pressure from a multiplicity of nozzles, however, this invention suffers from the same drawbacks as U.S. Pat. No. 6,929,533 (hereby incorporated by reference) in that lack of precision in the placement and form of the slurry substantially decreases its effectiveness. U.S. Pat. No. 4,910,155 (hereby incorporated by reference) describes the basic CMP process and utilizes a retaining wall around the polishing pad and polishing table to retain a pool of slurry on the pad. It does not describe a particular method for getting the pooled slurry into the pad wafer gap more effectively. U.S. Pat. No. 5,403,228 (hereby incorporated by reference) discloses a technique for mounting multiple polishing pads onto a platen in a CMP process. A seal of material impervious to the chemical action of the polishing slurry is disposed about the perimeter of the interface between the pads and when the pads are assembled the bead squashes and forms a seal and causes the periphery of the upper pad to curve upward creating a bowl-like reservoir for increasing the residence time of slurry on the face of the pad prior to overflowing the pad.

U.S. Pat. No. 3,342,652 (hereby incorporated by reference) teaches a process for chemically polishing a semiconductor substrate and a slurry solution is applied to the surface of the pad in bursts as a stream forming a liquid layer between the cloth and the wafers to be polished. The solution is applied from a dispensing bottle and is applied tangentially to the wafer-plate assembly so as to provide maximum washing of the polishing cloth in order to remove waste etching products. U.S. Pat. No. 4,549,374 (hereby incorporated by reference) shows the use of a specially formulated abrasive slurry for polishing semiconductor wafers comprising montmorillonite clay in deionized water." U.S. Pat. No. 6,284,092 (hereby incorporated by reference), teaches a CMP slurry atomization slurry dispense system in which " . . . a polishing slurry dispenser device disposed to dispense the slurry toward the pad preferably as a stream or more preferably drops toward the pad surface and a curtain of air to intersect the slurry at or near the polishing pad surface. The wafer is polished using less slurry than a conventional polishing apparatus while still maintaining the polishing rates and polishing uniformity of the earlier methods and polishing apparatus. A preferred dispenser is an elongated housing having a slurry tube and air tube therein each tube having a plurality of spaced apart slurry openings and air openings along its longitudinal axis which tube is preferably positioned radially over at least one-half the diameter of the polishing pad. A polishing slurry is directed from the slurry tube toward the surface of the pad, preferably in the form of drops, and the air from the air tube forms an air curtain, with the air curtain intersecting the slurry drops preferably at or slightly above the pad surface to atomize the slurry."

While this system distributes the slurry uniformly it does not do so in a way that insures that the thickness of the slurry layer at the leading edge of the wafer is at or close to the thickness of the gap. U.S. Pat. No. 6,398,627 (hereby incorporated by reference) teaches a slurry dispenser having multiple adjustable nozzles. In the teaching of that art, a "slurry dispensing unit for a chemical mechanical polishing apparatus equipped with multiple slurry dispensing nozzles is disclosed. The slurry dispensing unit is constructed by a dispenser body that has a delivery conduit, a return conduit and a U-shape conduit connected in fluid communication therein between for flowing continuously a slurry solution there through and a plurality of nozzles integrally connected to and in fluid communication with a fluid passageway in the delivery conduit for dispensing a slurry solution. The multiple slurry dispensing nozzles may either have a fixed opening or adjustable openings by utilizing a flow control valve at each nozzle opening. This patent, as with the previous art referred to, possesses no feature that ensures that the thickness of the slurry layer at the leading edge of the wafer is the same as the wafer pad gap.

U.S. Pat. No. 6,429,131 (hereby incorporated by reference) concerns CMP uniformity and teaches improved CMP uniformity achieved by providing improved control of the slurry distribution. Improved slurry distribution is accomplished by, for example, the use of a slurry dispenser that dispenses slurry from a plurality of dispensing points. Providing a squeeze bar between the slurry dispenser and wafer to redistribute the slurry also improves the slurry distribution. This invention can distribute slurry evenly over the pad but does not provide a uniform layer of slurry the thickness of the gap.

However, although the creation and maintenance of grooves and micro-channels are essential for the operation of CMP polishing generally, they still do not afford an efficient means of introduction of slurry between the pad and the wafer whereby most or even a substantial portion of the slurry introduced onto the pad is actually introduced between the pad and the wafer. Furthermore, although a great many methods have been designed for spreading the slurry evenly on the pad none to date have taught a method for preparing a layer of slurry suitably thick for smooth entry into the pad wafer gap. Most of the slurry continues to accumulate in a bow wave of slurry at the leading edge of the wafer which for the most part moves outward along the leading edge to be dumped off of the edge of the pad and wasted. Moreover, used slurry that has been under the wafer and is contaminated returns as the pad is rotated and mixed with the new slurry at the bow wave decreasing significantly the quality of the slurry used in actual CMP and increasing significantly the waste. And finally none of the methods of the prior art have reduced the negative effects on material removal and uniformity of residual slurry cleaning water added between wafers.

In U.S. patent application Ser. No. 12/262,579 (hereby incorporated by reference) is disclosed a device for injecting slurry between the wafer and the polishing pad in chemical mechanical polishing of semiconductor wafers comprising a solid crescent shaped injector the concave trailing edge of which is fitted to the size and shape of the leading edge of the polishing head with a gap of up to 1 inch, which rests on the pad with a light load, the bottom surface facing the pad, and through which CMP slurry or components thereof are introduced through one or more openings in the top of the injector and travel through a channel or reservoir the length of the device to the bottom where it or they exit multiple openings in the bottom of the injector and are, are spread into a thin film, and are introduced at the gap between the surface of the polishing pad and the wafer along the leading edge of the wafer in quantities small enough that all or most of the slurry is introduced between the wafer and the polishing pad and a method for using the same. In U.S. patent application Ser. No. 12/392,676 (hereby incorporated by reference) is disclosed a method for injecting slurry between the wafer and the pad in chemical mechanical polishing of semiconductor wafers using the apparatus described in U.S. patent application Ser. No. 12/262,579 comprising a solid crescent shaped injector the concave trailing edge of which is fitted to the size and shape of leading edge of the polishing head with a gap of between 0 and 1 inches, the bottom surface facing the pad, which rests on the pad with a light load, and through which CMP slurry or components thereof are introduced through one or more openings in the top of the injector and travel through a channel or reservoir the length of the device to the bottom where it or they exit multiple openings in the bottom of the injector, are spread into a thin film, and are introduced at the junction of the surface of the polishing pad and the wafer along the leading edge of the wafer in quantities small enough that all or most of the slurry is introduced between the wafer and the polishing pad, wherein multiple openings for the introduction of slurry to the device are utilized and fitted with devices that control the flow of slurry of various concentrations of diluents and adjustment is made to these devices during or after polishing to obtain a uniform distribution of new slurry on the land areas of the pad to in turn obtain a more uniform removal rate throughout the wafer.

These most recent applications have largely overcome the problems of the previous practice and are more effective than standard center application method of slurry and other earlier slurry addition methods and devices at lower slurry addition rates. However, it is a feature of these two inventions that with their leading edges they remove spent slurry more quickly than methods and devices of the prior art. Spent slurry is warmer than newly applied slurry due to accumulated heat generated by the friction that accompanies polishing of the wafer surface. At a specific CMP conditions, lower temperature can significantly depress removal rate of the wafer. Thus by quickly removing the spent slurry before it can again come into contact with the wafer, these inventions can lower the temperature on the surface of the wafer. Though this varies with CMP tool and the wafer, process and slurry involved, the temperature at the pad surface can be reduced by as much as 1 to 2 degrees resulting in lower removal rates and therefore longer polishing times to obtain optimal results.

PCT Patent Application US2010/60801 discloses a slurry injector for use in CMP to which one or more concave depressions or notches have been made into bottom surface of the leading edge of the slurry injector of U.S. patent application Ser. Nos. 12/262,579 and 12/392,676. More particularly the PCT Patent Application US2010/60801 teaches the said slurry injector for use in CMP wherein there are one or more and preferably 5 or more concave smoothly curved inner edges concave impressions or bays or notches. PCT Patent Application US2010/60801 also teaches a method for injecting slurry between the wafer and the polishing pad in chemical mechanical polishing of semiconductor wafers using the said slurry injector to prevent the depression of the temperature at the wafer surface due to the higher proportion of fresh unreacted slurry provided by the injector. The apparatus allows a small amount of higher temperature spent slurry from the bow wave in front of the leading edge of the injector to remain briefly at the leading edge warming the injector, the polishing pad and consequently the fresh slurry injected onto the pad surface by the injector without permitting significant mixture with or contamination of the new slurry by the spent slurry and to some extent the allowance of a certain amount of old slurry to be incorporated in the slurry used at the wafer where that is desirable for chemical reasons rate in a specific kind of CMP. For example in copper CMP process, there is the possibility that the slight increase in spent slurry that finds its way under the injector may in cases such as that of copper ion derived from copper plating removed by CMP that catalyzes the further chemical action against the copper sheet again increasing the removal.

The slurry injectors of PCT Patent Application US2010/60801 and U.S. patent application Ser. Nos. 12/262,579, 12/392,676 have largely overcome the problems of the prior art and are more effective than standard center application method of slurry and other prior art slurry addition methods and devices at lower slurry addition rates. During polishing, the slurry injector of PCT Patent Application US2010/60801 and U.S. patent application Ser. Nos. 12/262,579, 12/392,676 rests on top of the polishing pad, however, the slurry injector body is made by rigid material that may not conform well to a non-flat polishing pad. Despite an optimized polishing process itself and pad conditioning in particular, pad macroscopic thickness profile becomes non-flat during the course of the pad's life assumed to range from 30 to 60 hours. When the rigid injector body rest on top of non-flat polishing pad, some parts of the injector body do not conform well to the surface of polishing pad, thus reducing the effectiveness of the injector in achieving higher removal rate. This continuation-in-part introduces a feature where multiple slots are created in the top surface of the injector bottom. Thinner materials of injector bottom on the slots make the injector body become much more flexible and therefore able to conform to the pad profile during the whole pad life.

The slurry injector of U.S. patent application Ser. No. 12/262,579 discloses an injector device for injecting slurry between a semiconductor wafer and a polishing pad of a chemical mechanical polishing tool wherein the injector bottom surface rests on the polishing pad, and wherein the injector bottom surface comprises multiple injector bottom surface openings in fluid communication with the injector top surface opening. Particularly, U.S. patent application Ser. No. 12/262,579 also teach of slurry injector having multiple injector bottom surface openings align with one of a plurality of land areas on the polishing pad, further comprising a channel, wherein the multiple injector bottom surface openings are in fluid communication with the injector top surface opening through the channel. This continuation-in-part introduces a slit design created in the bottom section of the injector body facing directly to the pad surface to replace the multiple small openings. The slit has fluid communication with one or more injector top surface openings. When fresh slurry was injected through the inlet, it simply flowed along the slit onto the pad surface. Given the plurality of pad groove design, the slit design also improves and simplifies fresh slurry delivery injection to the pad land area. As an added benefit, it is easier to clean the slit.

One of the embodiments in U.S. patent application Ser. Nos. 12/262,579 and 12/392,676 disclose a device for injecting slurry comprising a solid crescent shaped injector the concave trailing edge of which is fitted to the size and shape of the leading edge of the polishing head with a gap of up to 1 inch. Our recent studies show that the slurry injector does not have to be placed as close as 1 inch to the polishing head to achieve the same effectiveness. Since the distance between injector body and polishing head (i.e. circular shape) does not need to be uniform at ~1 inch, a rectilinear (straight) injector body is preferable. A rectilinear injector body is also found to have better compatibility with various commercially available CMP platforms since many of them have a polishing head system that oscillates by as much as ~1 inch during polishing. In addition, the polishing head may travel back and forth from the polishing platen to other stations. A rectilinear injector body can be easily rested with light load on top of a polishing pad in a CMP polisher in a position allowing any kinematics of polishing head and conditioner.

U.S. patent application Ser. Nos. 12/262,579 and 12/392,676 disclose a slurry injection device which rests on the pad with a light load. The load is installed on top of the injector body; however, it does not teach the position of the load. Our internal studies indicate that during the polishing process, the trailing edge of the injector body tends to tilt up without an optimized load position. At the same time, the leading edge of the injector tilts down and can plough severely into the polishing pad as the polishing pad impinges the leading edge of the injector, causing vibration. This continuation in part teaches to set the center of gravity towards the trailing edge of the injector for increased stability during polishing.

Embodiments of U.S. patent application Ser. Nos. 12/262,579 and 12/392,676 disclose a slurry injector that rests on top of the pad having a flat injector bottom facing the surface of the pad with a preferably right angle on the leading edge of the injector bottom facing the surface of the pad. As the injector rests gently on top of the pad surface during polishing, the leading edge of the injector blocks the spent slurry and residual DI water from re-entering the pad-wafer interface, minimizing the slurry mixing and dilution effects. However, for particular combinations of polishing conditions and consumables, gross vibration may occur. A flat injector bottom, combined with frictionally induced tilt of the injector, creates suction pressure between the surface of the injector bottom and the surface of the pad. A flat pad or a pad with little grooving area such as DOW IC1000 k-groove induces higher suction pressure than pad with more grooving area. When suction pressure develops during polishing, the leading edge of the said injector body will be forced to tilt down toward the pad due to an increase in the frictional shear force, causing the leading edge of the injector bottom with a sharp right angle to cut or plough into the pad surface as the polishing pad impinges the leading edge of the injector. This continuation in part also teaches how to solve such an issue by incorporating a shallow step or groove on the bottom surface of the injector bottom that rests on the pad to break the suction pressure between the injector and the pad. In addition, the leading edge of the injector bottom facing the polishing pad is chamfered (rounded) allowing the pad to slide smoothly along the rounded leading edge bottom. While the chamfered injector bottom may become less effective in blocking the spent slurry and residual DI water from re-entering the pad-wafer interface compared to the injector having a right angle in the leading edge of the injector bottom facing the pad, the groove on the bottom surface of the injector compensates by partially blocking the spent slurry and residual DI water that finds its way past the rounded bottom at the leading edge of injector body.

During our internal tests, we first used polycarbonate to construct the bottom section of the injection device. After 10 hours of polishing, we discovered appreciable wear on the polycarbonate bottom of the injection device due to contact with the pad and slurry abrasives during polishing. To achieve a longer life for the system, we replaced the polycarbonate with poly-ether-ether-ketone (PEEK). The latter is well known for its wear resistance and is already used in CMP processes to construct retaining rings, which also contact the pad and slurry abrasives.

The inventor of the disclosed invention, seeking to make a more efficient use of slurry in CMP processes and a more efficient method of introduction of slurry between the pad and the wafer that insures that more new slurry is advected under the wafer and a higher percentage of old used is slurry disposed of as waste, and that overcomes the deleterious effects of residual wash water on the CMP pad to subsequent slurry concentration and, hence, removal rates and uniformity has, after considerable research and effort directed to solving this problem, discovered a device and a method for the efficient introduction of slurry between the pad and the wafer that will largely eliminate the waste of slurry, mixing of old and new slurry and residual wash water dilution effects characteristic of the CMP polishing methods of earlier methods and allow the operator of rotary CMP polishing equipment considerable control over the introduction of slurry between the wafer and the pad. More particularly, the inventor has invented an apparatus for use in chemical mechanical polishing of semiconductor wafers that applies slurry between the wafer and the pad near the leading edge of the wafer in a thin film that is comparable in thickness to the gap between the pad and the wafer, thus substantially reducing the volume of the wafer leading edge slurry bow wave, and ensuring that a high fraction of fresh slurry is used for polishing. The apparatus also creates a second bow wave at the leading edge of the injector, physically separated from the wafer leading edge bow wave that contains only residual wash water and polishing by-products; mainly containing spent slurry and pad debris. Most slurry disposal or waste is from this second bow wave, which also catches and disposes of most of the rinse water and incompletely mixed rinse water and slurry present at the onset of polishing that otherwise would enter the pad-wafer gap and exert a negative effect on removal rates and uniformity. In addition, when a groove on the bottom surface of the injector bottom, facing the pad surface, is created, the apparatus also creates a third bow wave at the trailing sidewall of the groove, blocking residual wash water and polishing by-products that find their way past the leading edge of the injector. This apparatus, incorporating these two elements, allows a CMP tool to use a significantly lower overall slurry flow rate, by reducing the mixing of fresh and used slurry and the uncontrolled dilution of slurry by wash water prior to use at the wafer, by insuring that the utilization of fresh slurry is close to 100 percent, and by ejection of only used slurry and wash water. This apparatus also allows a CMP tool to reduce wafer defects by blocking the defect-causing polishing by-products that may contain pad debris, dislodged diamond chips from conditioner debris, as well as any unwanted objects, from entering the pad wafer region.

This apparatus more particularly comprises a rectilinear shaped injector. Multiple slots are created in the top surface of the injector bottom, allowing the injector body to flex and to conform to the pad profile. The injector bottom rests on the pad with a light load, having a center of gravity located toward the trailing edge of the injector. The injector is resting on the surface of the pad held by rods to the support mechanism of the CMP polisher, by means of which it may gimbal freely in terms of bank and pitch angles to the extent permitted by the pad surface, but may not rotate in the horizontal plane. The material used in the construction of the injector bottom is PEEK. A CMP slurry or components thereof are introduced through one or more openings in the top of the injector, where it or they exit through a slit or slits in the bottom of the injector and are spread into a thin film, and are introduced at the gap between the surface of the polishing pad and the wafer along the leading edge of the wafer in quantities small enough that all or most of the slurry is introduced between the wafer and the polishing pad.

When the injector does not incorporate bays, depressions or notches that are cut, shaped or molded on the bottom surface of the injector bottom as taught in PCT Patent Application US2010/60801, this apparatus more particularly comprises a rectilinear shaped injector with multiple slots in the top surface of the injector bottom, allowing the injector body to conform well to the pad profile. The injector rests on the pad with a light load, having a center of gravity located toward the trailing edge of the injector. The injector is resting on the surface of the pad held by rods to the support mechanism of the CMP polisher, by means of which it may gimbal freely in terms of bank and pitch angles to the extent permitted by the pad surface, but may not rotate in the horizontal plane. The bottom surface of the injector bottom, facing the pad, is rounded (chamfered) at the leading edge. In some embodiments a groove is located on the bottom surface of the injector bottom, between the leading edge and trailing edge of the injector. In some embodiments the material used in the construction of the injector bottom is PEEK. CMP slurry or components thereof are introduced through one or more openings in the top of the injector, where it or they exit through one or more than one opening in the bottom of the injector. In some embodiments the one or more than one opening resides in a slit in the bottom surface of the injector bottom. The slurry or components thereof are spread into a thin film, and are introduced at the gap between the surface of the polishing pad and the wafer along the leading edge of the wafer in quantities small enough that all or most of the slurry is introduced between the wafer and the polishing pad.

The inventor has discovered a method in CMP for an applying slurry between the wafer and the polishing pad near the leading edge of the wafer in a thin film that is comparable to the polishing pad-wafer gap, thus reducing or eliminating the wafer leading edge bow wave and insuring that a high fraction of fresh slurry is used for polishing the wafer, and creating a second bow wave at the leading edge of the injector, physically separated from the wafer leading edge bow wave, that contains only residual wash water and polishing by-products. The method includes the use of a rectilinear shaped injector, where the injector includes multiple slots in the top surface of the injector bottom. The multiple slots allow the injector body to conform well to the pad profile during the course of the pad's life. The injector rests on the pad with a light load, having a center of gravity located toward the trailing edge of the injector. CMP slurry or components thereof are introduced through one or more openings in the top surface of the injector bottom. The CMP slurry or components travel through the injector, exiting through a slit or slits in the bottom of the injector, and are spread into a thin film, and are introduced at the gap between the surface of the polishing pad and the wafer along the leading edge of the wafer in quantities small enough that all or most of the slurry is introduced between the wafer and the polishing pad.

In some embodiments a groove on the bottom surface of the injector bottom, facing the pad surface, is created. Thus a method in CMP for applying slurry between the wafer and the polishing pad near the leading edge of the wafer in a thin film that is comparable to the polishing pad wafer gap is described. The method reduces or eliminates the wafer leading edge bow wave and insures that a high fraction of fresh slurry is used for polishing the wafer. The method creates a second bow wave at the leading edge of the injector, and a third bow wave at trailing side wall of the groove. The second bow wave is physically separated from the wafer leading edge bow wave. The second bow wave contains only residual wash water and polishing by-products. The method is implemented by utilization of a rectilinear shaped injector with multiple slots in the top surface of the injector bottom, allowing the injector body to conform well to the pad profile during the course of the pad's life. The injector rests on the pad with a light load, having a center of gravity located toward the trailing edge of the injector. CMP slurry or components thereof are introduced through one or more openings in the top of the injector, where it or they exit into a slit or slits in the bottom of the injector and are spread into a thin film, and are introduced at the gap between the surface of the polishing pad and the wafer along the leading edge of the wafer in quantities small enough that all or most of the slurry is introduced between the wafer and the polishing pad The apparatus of the disclosed invention has been developed in response to the present state of the art, and in particular, in response to the problems and needs in the art that have not yet been fully solved by currently available CMP slurry supply systems for CMP tools. Thus, it is an overall objective of the disclosed invention to provide CMP slurry injectors and related methods that remedy the shortcomings of the prior art.

The purpose of this device and method are to allow more effective injection of slurry into the space between the polishing pad and the wafer, and to prevent new slurry being contaminated by old slurry that has remained on the pad after use under the wafer, and by residual water used to clean the polishing pad between wafers. Much of the new slurry added to the polishing pad by conventional means forms a bow wave in front of the leading edge of the wafer or the wafer retainer. In this bow wave is new and used slurry as well as residual water mix. In this case much slurry, including new slurry, is diluted or allowed to flow off of the polishing pad, and is wasted. The slurry reaching the pad-wafer region contains a substantial portion of old slurry, and is often at levels of dilution that are either inconsistent and produce variable removal rates or is too diluted to support effective removal. Particularly, the injector according to the invention features multiple slots in the top surface of the injector bottom. Thinner materials on the injector bottom inside the slots make the injector body become much more flexible, and therefore the injector body is able to conform to the pad profile during the whole pad life, as the pad surface profile may become non-flat. In some embodiments the bottom section of the injector body, facing directly to the pad surface, includes a slit or slits. The slit or slits are in fluid communication with one or more injector top surface openings. When fresh slurry is injected through the top surface opening or openings, it simply flows along the slit(s) onto the pad surface. This makes it easy to clean the slit and no slurry residues were observed around the slit after wafer polishing and rinsing. Given the plurality of pad groove designs, the slit(s) design also improves and simplifies fresh slurry delivery injection to the pad land areas.

CMP slurry should be new (pre-diluted) slurry so that it is more able to wear away and planarize the surface of wafers for such semiconductor wafers as silicon wafers or silicon compound wafers that have been plated with copper or tungsten or other materials, and thereafter to planarize the semiconductor surface itself. When old slurry or water are allowed to mix with new slurry in large and uncontrolled amounts, and much of this mixture is allowed to be disposed of from the polishing pad without ever having been used under the wafer, there is substantial waste of slurry and the slurry that does eventually find its way under the wafer is not entirely effective. However, without this mixing, the cooler temperature of the new slurry results in a lower reaction rate. The unique and original design of the new invention preserves the benefits to the CMP process and the reduction of slurry use of maintaining the separation of new and spent slurry while at the same time obtaining the benefits of the higher temperature of the spent slurry on reaction rates and to some extent the allowance of a certain amount of old slurry to be incorporated in the slurry used at the wafer, where that is desirable for chemical reasons as well as in maintaining a higher reaction temperature.

Manufacturers and users of CMP pads need to minimize slurry waste, maintain suitable reaction temperatures at the wafer surface, and maximize slurry efficiency and consistency in quality of the slurry applied, to obtain the most cost effective and high quality polishing of wafers.

The problem of waste and the resultant inconsistent and often poor quality of the slurry that ends up under the wafer has been known in the art for some time.

The problem of waste and the resultant inconsistent and often poor quality of the slurry that ends up under the wafer has been known in the art for some time and was largely solved by the inventions of PCT Patent Application US2010/60801, U.S. patent application Ser. Nos. 12/262,579 and 12/392,676. The invention disclosed in those three applications, however, was observed to raise the problems of (1) a rigid injector body that rests on top of non-flat polishing pad that may not conform to the pad surface as the pad macroscopic thickness profile becomes non-flat during the course of the pad's lifetime, (2) bottom surface openings comprising a channel to align with one of a plurality of land areas on the polishing pad, (3) a non-optimum load position on top of the injector causing vibration due to the leading edge of the injector to tilt down and plough severely into the polishing pad as the polishing pad impinges the leading edge of the injector and (4) a combination of a right angle on the leading edge of the bottom surface and flat injector bottom that can creates suction pressure between the surface of the injector bottom and the surface of the pad, leading to instability of the injector during polishing.

The disclosed invention overcomes the problems of previous methods by (1) creating one or more than one slot in the top surface of the injector bottom, where the thinner material of the injector bottom in the slots make the injector body become much more flexible and therefore able to conform to the pad profile during the whole pad life, (2) creating slit(s) in the bottom of the injector body, directly facing the pad surface, where the slit(s) are in fluid communication with the one or more injector top surface openings so that fresh slurry that is injected through the top surface opening(s) simply flows along the slit onto the pad surface, allowing improvement and simplification of slurry delivery to the pad land areas and (3) arranging dead weights on top of the injector to set the center of gravity towards the trailing edge of the injector for increased stability during polishing. Additionally, (4) when the injector does not incorporate bays, depressions or notches that are cut, shaped or molded on the bottom surface of injector bottom as taught in PCT Patent Application US2010/60801, the disclosed invention overcomes the problems of previous methods by creating a groove on the bottom surface of the injector bottom that rests on the pad, to break the suction pressure between the injector and the pad. In some embodiments a rounded (chamfered) bottom is formed on the leading edge of the injector bottom that faces to the polishing pad, allowing the pad to slide smoothly in the case and as the rounded injector bottom may become less effective in blocking the spent slurry and residual DI water from re-entering the pad-wafer interface compared to the injector having a right angle in the leading edge of the injector bottom facing the pad, the groove on the bottom surface of the injector bottom is also effective in blocking the spent slurry and residual DI water that find its way past the rounded bottom at the leading edge of injector body. It must be noted that when the injector incorporates enough bays, depressions or notches that are cut, shaped or molded on the bottom surface of injector bottom as taught in PCT Patent Application US2010/60801, the said bays, depression or notches are effective enough to break the suction pressure between the injector and the pad, therefore the bottom surface of the injector bottom that rests on the pad does not need any additional grooves.

Through the use of the slurry injector of the disclosed invention, consistent, effective and reduced volume usage of slurry use can be achieved easily with improved polished wafer quality.

All dimensions for parts in the disclosed invention follow are based on a pad size of about 20" to 30" in diameter and a wafer size of between [8"] and [12"] in diameter and may be altered as needed in proportion to changes in the size of the polishing pad and wafer used. The specific dimensions given herein are in no way limiting but are by way of example to demonstrate an effective embodiment of the invention.

The disclosed invention comprises a device and a method for the efficient introduction of slurry between the polishing pad and the wafer, that while largely eliminating the waste of slurry characteristic of the CMP polishing methods of the earlier practice, allows the use of a purer unused and undiluted slurry at the polishing pad surface at all times, and allows the operator of the CMP polishing equipment considerable control over the introduction of slurry between the wafer and the polishing pad. More particularly, as shown in FIG. 1 through FIG. 6, the disclosed invention comprises an injector device (110) for injecting slurry between the wafer and the polishing pad in the chemical mechanical polishing of semiconductor wafers. The injector (110) comprises a rectilinear shaped injector bottom (123) with a leading edge (121) and a trailing edge (122). In some embodiments the leading edge (121) is straight. In some embodiments the trailing edge (122) is straight. In some embodiments the injector (110) has a plurality of slots (161) formed in the top surface of the injector bottom (123) resulting in multiple segments (111) of injector bottom (123) which rests on the polishing pad (183). In some embodiments the injector has a $1^{st}$ layer of dead weights (172) attached to each segment (111) of injector bottom (123) via an intermediate layer (171). In some embodiments the injector has a $2^{nd}$ layer of dead weights (173) arranged toward the trailing edge (122) of the injector. In some embodiments the injector (110) has a center of gravity between the leading edge (121) and the trailing edge (122), where the distance from the leading edge (121) to the center of gravity is larger than the distance from the center of gravity to the trailing edge (122).

The bottom surface (125) of the injector is essentially flat and parallel to the top surface (186) of the polishing pad (183) in some embodiments. CMP slurry or components thereof are introduced through one or more tubes (133) or other suitable means of delivery coupled to one or more top surface openings or inlets (131) in the top surface of the injector (110). The slurry flows to the pad surface (183) through one or more slurry bottom surface opening (outlet opening) (132) in the bottom surface of the injector bottom (123). The one or more than one bottom surface opening (132) is in fluid communication with the one or more than one top surface opening (131). In some embodiments the one or more than one bottom surface opening (132) in the bottom surface (125) form slits (132) that run the length or partial length of the injector (110) in the bottom surface (125) of the injector bottom (123). In some embodiments the one or more than one bottom surface opening (132) is located in the slit. In some embodiments the slit runs parallel to the trailing edge (122). CMP slurry introduced through the one or more than one injector top surface opening (131) travels through the injector bottom (123) and exits the injector device (110) through the one or more than one bottom surface opening (132) onto the polishing pad top surface (186).

The slurry is pressed between the bottom surface (125) of the injector bottom (123) and the polishing pad (183) top surface (186), spread into a thin film and introduced at the gap between the top surface (186) of the polishing pad (183) and the wafer (184), along the leading edge (185) of the wafer (184), in quantities small enough and in a film thin enough so that all or most of the slurry is introduced between the wafer (184) and the polishing pad (183). Used slurry is more effectively kept separate from newly injected slurry by its concentration in a second bow wave (128) at the leading edge (121) of the injector (110).

In some embodiments, particularly when the bottom surface (125) of the leading edge (121) of the injector (110) which rests on the top surface (186) of the polishing pad (183) does not possess one or more bays, depressions or notches such as those disclosed in PCT Patent Application US2010/60801, the disclosed invention also introduces a rounded (chamfered) edge (124) at the leading edge (121) of the bottom surface (125) of the injector bottom (123). In some embodiments the injector bottom (123) has a groove (140) between the leading edge (121) and trailing edge (122) of the injector (110) running along the length or partial length of the injector body (110). In some embodiments the groove includes a leading sidewall (127) and a trailing sidewall (126). In some embodiments the leading sidewall extends in a direction parallel to the leading edge (121). In some embodiments the trailing sidewall extends in a direction parallel to the trailing edge (122). Thus used slurry is more effectively kept separate from newly injected slurry by its concentration in a second bow wave (128) at the leading edge (121) of the injector (110) and a third bow wave (129) at the trailing sidewall (126) of the injector bottom groove (140) close to the trailing edge (122) of the injector (110).

Moreover, the disclosed invention comprises a method for injecting slurry for chemical mechanical polishing of semiconductor wafers between the surface of the wafer (184) and the top surface (186) of the polishing pad (183) by utilization of an injector device for injecting slurry between the wafer (184) and the polishing pad (183) in CMP polishing. The injector device comprises an injector (110) with a leading edge (121) and trailing edge (122) having multiple slots (161) that are created in the top surface of the injector bottom (123). In some embodiments the leading edge (121) is straight. In some embodiments the trailing edge (122) is straight. In some embodiments the injector (110) is rectilinear shaped. In some embodiments the injector bottom (123) rests on the polishing pad (183) with light loads (172) attached to injector bottom (123) via an intermediate layer (171) having additional loads (173) located toward the trailing edge (122) of the injector. The thinner material of the slot bottom (162) of the slots (161) on the injector bottom (123) are flexible enough to allow the injector bottom (123) of the injector (110) to conform to the profile of the pad macroscopic surface (186). In particular the profile of the "land" areas (189) between the pad grooves (188) becomes worn "land" areas (199) in the polishing pad (183) and become non-flat during the course of the pad's life. CMP slurry or components thereof are introduced through one or more tubes (133) or other suitable means of delivery attached to one or more openings (131) in the top surface of the injector (110) and flow to the pad surface (183) through one or more slurry outlet openings or slits (132) which run the length or partial length of the injector (110) in the bottom (123) thereof. The slurry is pressed between the said bottom (123) of the injector (110) and the polishing pad (183), spread into a thin film, and introduced at the gap between the surface of the polishing pad (183) and the wafer (184) along the leading edge (185) of the wafer (184), preferably on the "land" (189) areas between the pad grooves (188) in the polishing pad (183), in quantities small enough and in a film thin enough so that all or most of the slurry is introduced between the wafer (184) and the polishing pad (183) and by which used slurry is more effectively kept separate from newly injected slurry by its concentration in a second bow wave (128) at the leading edge (121) of the injector (110).

As the polishing tool, any suitable rotary polishing tool may be used. In particular existing rotary polishing tools may be retrofitted with the apparatus of the disclosed invention. Any polishing pad (183) suitable for use in CMP may be used. Moreover, any diamond conditioner disk suitable for use in CMP may be used.

For the slurry, any applicable CMP slurry may be used and for example, silica based and alumina based slurries may either or both be used.

The injector bottom (123) may be constructed of any hard material that is flexible and resilient enough to allow the injector bottom (123) to conform with the pad macroscopic surface profile, such as engineered plastic or ceramic, suitable for CMP processes shaped by any suitable means to include a plurality of slots (161), slurry inlets or top surface openings (131), slurry outlet bottom surface openings or slits (132), trailing edge (122) and leading edge (121), where applicable, rounded edge (124) at the leading edge (121), a groove (140) or in parts to be joined or by layers. PEEK is the preferred material for injector bottom (123) as PEEK is light, durable and highly wear-resistant. The injector bottom (123) may be of any thickness that is not so thin as to result in an injector (110) too weak to endure the rigors of CMP polishing or so thick as to be cumbersome and inapplicable may be used. Before creating the slots (161), a uniform thickness of 0.25 inch for the injector bottom (123) is preferred.

The number of the plurality of slots (161) is not particularly limited and any suitable number may be used however five or more slots (161) is preferred and eight or more slots (161) is more preferred. In some embodiments one slot (161) is used. The slots (161) run from the leading edge (121) to the trailing edge (122). The depth of each of the plurality of slots (161) extends from the top surface of the injector bottom (123) into the injector device bottom (123). The depth of each of the plurality of slots (161) does not extend all the way to the injector bottom surface (125).

The slots (161) are cut from the leading edge (121) to trailing edge (122) in the top surface of the injector bottom (123) leaving a thin section (162) of injector bottom material. The size of the said slots (161) is not particularly limited, however the said slots (161) should not be too wide and too deep so that they drastically reduced the mechanical integrity of the injector body when held by itself as well as during usage in a normal operation of CMP nor too small and too shallow that they do not provide sufficient flexibility of injector body to conform with the pad surface (186). A slot (161) width between 0.5 mm and 3 mm is preferred. The sidewalls of a slot (161) may be parallel and flat, may be at a slight planar angle with respect to one another or may be slightly rounded. Parallel, smooth planar sidewalls of a slot (161) are preferred. The bottom surface (164) of a slot (161) may be parallel and flat to the bottom surface (125), may be at a slight planar angle with respect to the bottom surface (125) or may be slightly rounded. Parallel, smooth planar bottom surface (164) of a slot (161) is preferred. The thin section (162) of injector bottom (123) as a result of a slot (161) with a thickness between 0.5 mm to 2 mm is preferred. The shape and orientation of the slots (161) is not particularly limited, however straight and uniform slots (161) perpendicular to the leading edge (121) and trailing edge (122) of the injector bottom is preferred.

In embodiments where the bottom surface (125) of the injector (110) which rests on the polishing pad (186) possesses one or more bays, depressions or notches as taught in PCT Patent Application US2010/60801, the slots (161) are preferably created in between the bays, depressions or notches.

In embodiments where the bottom surface (125) of the injector (110) has groove(s) (140), care should be taken to avoid making a cut-out between groove(s) (140) and the slots (161) as there should be a thin material (162) separating the groove(s) (140) and the slots (161). In any cases, care should be taken to have thin materials (162) throughout the slots (161).

The load of the injector (110) resting on the polishing pad (183) is between 0.5 and 10 lb or more and generally is sufficient to apply enough pressure so that the mean gap (187) between the bottom surface (125) of the injector (110) and the polishing pad (183) is comparable within a small multiple to the mean gap between the wafer (184) and the pad (183). The latter is frequently measured to be between 10 and 25 microns, but larger or smaller gaps are also possible. A load may be applied using a combination of $1^{st}$ layer of dead weights (172) and $2^{nd}$ layer of dead weights (173) arranged on the top of each segment (111) of injector bottom (125). $1^{st}$ layer of dead weights (172) are preferably joined to each segment (111) the injector bottom (125) with intermediate layer (171) in between. The intermediate layer (171) can be made of any materials; however, polycarbonate sheet is preferred. The footprint's shape and size of intermediate layer (171) and $1^{st}$ layer of dead weights (172) can be any shape and size, however, a shape and size similar to the segment (111) of injector bottom (123) is preferred. $2^{nd}$ layer of dead weights (173) are arranged on top of $1^{st}$ layer of dead weights (172) toward the trailing edge (122) of injector (110). The footprint's shape and size of the $2^{nd}$ layer of dead weights (173) can be any shape and size, however, a smaller size compared to the $1^{st}$ layer of dead weights (172) is preferred. Having a dead weight with a size and shape similar to a combined $1^{st}$ layer of dead weight (172) and $2^{nd}$ layer of dead weight (173) is possible. The injector bottom (125), intermediate layer (171), $1^{st}$ layer of dead weights (172) and $2^{nd}$ layer of dead weights (173) are joined together by any suitable means, however joining the injector bottom (125) and intermediate layer (171) with a chemically-resistant, closed cell foam with chemically-resistant double sided adhesive is preferred and joining intermediate layer (171), dead weights (172) and additional dead weights (173) with dowels is preferred. Per FIGS. 2 and 4, an injector holder (165) is installed on intermediate layer (171) through the $1^{st}$ layer of dead weight (172) on the first and last segments (111). The injector holder (165) can be any numbers, length, materials at any location of segments (111). The injector holder (165) is to hold the rod (191) and/or rod end (192).

In order to block the slurry passing through the slots (161) during CMP process, the said slots (161) have to be closed with fillers (163). The material of the fillers on the slots (161) is not particularly limited, however, that materials that are flexible and highly chemical resistant are preferable. The fillers (163) are also attached to the sidewalls of slots (161) by any means such as adhesive layer and glue. In addition, any spaces between intermediate layers (171) which are typically located above the slots (161) is preferably closed as well with fillers (163) to block the slurry passing through the said spaces. The material of the fillers is not particularly limited, however, that materials that are flexible and highly chemical resistant are preferable. The fillers (163) are also attached to the sidewalls of the said spaces by any means such as adhesive layer and glue.

The bottom surface (125) of the injector (110) facing the polishing pad (183) is flat and smooth in some embodiments, though depending upon need it may be textured, grooved or shaped. In a particular embodiment, to reduce injector vibration in a certain polishing conditions and consumables, the bottom surface (125) of the injector (11) is rounded (124) at the leading edge (121). The radius of curvature of the rounded edge (124) can be any size; however, radius of curvature between 0.5 mm and 1.5 cm is preferred. The bottom surface (125) of the injector (11) can have a groove (140) extending along a length of the injector bottom in between the leading edge (121) and the trailing edge (122) of the injector (110) and preferably, the groove (140) is created in between the leading edge (121) and slurry outlet slit(s) (132) of the injector (110). In some embodiments the length of the injector bottom that the groove extends along is the full length of the injector body. In some embodiments the length of the injector bottom that the groove extends along is a partial length of the injector body. The leading sidewall (127) and trailing sidewall (126) of an injector bottom groove (140) may be parallel and flat, may be at a slight planar angle, may have curvature or may be slightly rounded. Having a parallel, smooth planar leading sidewall (127) and trailing sidewall (126) of an injector bottom groove (140) is preferred. The upper surface (141) of the injector bottom groove (140) may be parallel and flat to the bottom surface (125), may be at a slight planar angle with respect to the bottom surface (125) or may be slightly rounded. A parallel, smooth planar upper surface (141) of the groove (140) is preferred. In the event that multiple grooves (140) are used any positioning and pattern may be used but placing the multiple grooves (140) in parallel to each other is preferred. The size of the said groove (140) is not particularly limited, however the said groove (140) should not be too wide so that it drastically reduces the contact area of the bottom surface (125) to the pad surface (186) resulting in too high pressure and thereby less stable injector body nor so small that the third bow wave (129) cannot be effectively formed. A total groove (140) width approximately 20 percent to 80 percent of the distance between leading edge (121) and trailing edge (122) of the injector (110) is preferred.

The slurry bottom surface openings or outlet slits (132) by which the slurry exits the injector (110) in the bottom surface (125) of injector (110) may have any numbers, shapes and sizes but a long, thin rectangular bottom surface opening (132) is preferred. The width of the slurry outlet slit (132) may be any width but a width between 0.5 mm and 4 mm is preferred. The depth of the slurry outlet slit (132) may be any depth but a depth between 0.5 mm and 2 mm is preferred. The slurry outlet slit (132) may be made perpendicular to the bottom surface (125) or at an angle. The slurry outlet slit (132) may be made by any suitable means but milling is preferred. In the event that multiple slurry outlet slits (132) are used any positioning and pattern may be used but placing the multiple slurry outlet slits (132) closer to trailing edge (122) of injector bottom (123) is preferred. Slurry outlet slits can communicate with one or more slurry inlets (131).

The means of introducing slurry to the solid crescent shaped injector (110) is not particularly limited but the pre-existing tube (133) of commercially available CMP polishers attached directly to the slurry top surface opening or inlet (131) of the injector (110) is preferred. Alternatively, the slurry inlet (131) can be connected by any suitable means to a tube (133) but a quick connect coupling is preferred. Multiple slurry inlets (131) can be individually connected to chemical supplies via multiple tubes. Alternatively, a single chemical supply is connected to a manifold capable of distributing chemical to multiple outlets to connect individually to slurry inlets (131) via tubes (133). For the positioning of the slurry inlet openings (131) in the top of the injector (110), any positioning or pattern may be used but, at least, a position closest to the center of the pad (183) is preferred. The size and number of the slurry bottom surface openings or outlet slits (132) and whether it is a narrow slit or a short slit should be considered when positioning of the slurry inlets (131).

In the event that the slurry is pumped into the injector (110), any suitable flow rate may be used, for example, slurry may be pumped at the rate of 30 to 300 cc per minute. A flow meter or other suitable sensors may be added to monitor slurry flow preferably before the point of entry into the injector (110).

The rectilinear shaped injector (110) position on the polishing pad (183) can be maintained by means of any suitable device but rods (191) to which the injector (110) is attached is preferred. The number of rods can be any number; however two or more rods (191) are preferred. The rods (191) should be strong enough to withstand the rigors of the CMP process and should be between 0.25 inch and 0.75 inch in diameter or thickness as the case may be. Delrin (acetal homopolymer) is preferred as their component material. The injector (110) should be detachable from the rods (191) so that it may be cleaned or replaced when needed. The point of contact between the injector (110) and the rods (191) or other means of support in the disclosed invention is rod ends (192). Igubal® rod ends with model number EBRM-HT and F.K. Bearings SCM4T are the preferred rod ends (192). To the injector (110), the rod end (192) is attached by a screw (163) to the intermediate layer (171) of injector (110). The rod (191) and/or rod end (192) can be directly mounted to the part of polisher body (193), however, having rod (191) and/or rod end (192) mounted on the support mechanism (194) is preferred and having a rod (191) with a rod end (192) mounted on the support mechanism (194) is more preferable. The support mechanism (194) can be positioned and attached to the part of polisher body (193) by any suitable means. The length and the position of the rods (191) and/or rod ends (192) to the support mechanism (194) and injector (110) can have any lengths and mechanically-stable positions but should have a thickness that is not so thin as to be too weak to endure the rigors of CMP polishing or so thick as to be cumbersome or to interfere with the operation of the CMP tool.

The combination of rod ends (192) acts as a gimbal mechanism to the injector (110) so that bottom surface (125) of the injector (110) lies flat against the polishing pad (183) surface (186). The gimbal mechanism and slots (161) in the injector bottom (125) allow the operator to lay down a very thin film of slurry and in so doing also effectively segregate the used slurry in bow waves at the leading edge (121) of the injector (110) and at the trailing sidewall (126) when the injector bottom groove (140) is created without losing the flat orientation of the bottom surface (125) of the injector (110) as it sits on or above the polishing pad (183).

EXAMPLES

The injector was fabricated with an injector bottom made of PEEK, an intermediate layer made of clear polycarbonate (GE Plastics XL10, 0.5 cm thickness), dead weights and additional dead weights made of stainless steel (grade 316). For the injector bottom, PEEK material with an as-received thickness of ~0.65 cm was milled to a rectilinear (rectangular) shape [FIG. 1] approximately 25.4 cm long from end to end and a width of ~3.8 cm. Eight equidistant slots were created by milling the top surface of the injector bottom perpendicular to the leading edge and trailing edge of injector bottom with a depth of ~0.5 cm and a width of ~0.016 cm resulting nine segments of injector bottom having similar sizes. Per FIG. 6, segments 1 and 9 are referred as segments close to center of the polishing pad and edge of the polishing pad, respectively. All eight slots were partially filled at the edges using 1/16" thick double-sided soft foam tape (Can-Do National Tape #99116). By milling, a groove on the bottom surface of injector bottom was created parallel to the leading edge and trailing edge of injector bottom having a uniform width of ~2.2 cm and a uniform depth ~0.03 cm. The trailing sidewall of the said groove is created at ~1.3 cm from the trailing edge of the injector bottom. The leading edge of the bottom surface of the injector bottom facing the polishing pad is rounded by milling with a radius of curvature of ~0.2 cm. A slit for slurry outlet is created by milling at the bottom surface of the injector bottom having a depth of ~0.08 cm, a width of ~0.16 cm and a length of ~24.3 cm. The slit is created uniformly at ~0.6 cm from the trailing edge of the injector bottom. The slit for slurry outlet has fluid communication with 5 injector top surface openings for slurry inlet supplies created on segments 1 to 5 individually. Each opening was created by, first, drilling with ~0.16 cm bit through the center of the slit at the particular segment of injector bottom for ~0.23 cm depth relatively to bottom surface of injector bottom and at the same location, followed by drilling with ~0.5 cm bit from the top surface of the injector bottom for ~0.42 cm. The holes were perpendicular to the bottom surface of the injector bottom. Nine intermediate layer polycarbonate pieces were milled with the same footprint size of each injector bottom segment. A hole overlapping the slurry supply hole on the injector bottom were created on each intermediate layer for segments 1 to 5 by drilling with a ~0.5 cm bit. A screw hole for a 1/4" cap screw was created in the middle of the intermediate layers for segments 1 and 8. Intermediate layers were attached to the injector bottom using 1/16" thick double-sided soft foam tape (Can-Do National Tape #99116) with holes on segments 1 to 5 for slurry supply openings. Nine of $1^{st}$ layer dead weights with a thickness of ~0.77 cm were cut and drilled with the same footprint as the intermediate layers placed beneath. The $1^{st}$ layer of dead weights was attached to the polycarbonate intermediate layer using two 0.125" acetyl dowels. Additional holes on the top surface of the intermediate layer and on the bottom surface of $1^{st}$ layer of dead weights were created to accommodate the dowels. Seven of $2^{nd}$ layer dead weights for segments 2 to 7 and 9 with a thickness of ~0.93 cm were cut with the same width as the $1^{st}$ layer dead weights and a length of ~2.54 cm. A hole was created on four of $2^{nd}$ layer dead weights for segments 2 to 5 to accommodate the slurry supply openings by drilling with ~0.8 cm bit. Pairs of $1^{st}$ layer and $2^{nd}$ layer of dead weights were attached to each other using two 0.125" acetyl dowels. Additional holes on the top surface of the $1^{st}$ layer dead weight and on the bottom surface of the $2^{nd}$ layer of dead weights were created to accommodate the dowels. For slurry inlet tubes, PFA tubing with 1/4" OD, 1/32" wall thickness and 2.8 cm long were attached to the slurry opening holes located in segments 1 to 5.

A DOW IC-1000 groove-1 CMP pad was attached to an Araca Incorporated APD-800 CMP polishing tool and a 3M A2810 conditioning disk was attached as well. The injector body was held by a Delrin mount with two rod ends (F.K. Bearings SCM4T) and attached to the support mechanism of the CMP tool using a bracket and stainless steel screws. The injector body was positioned on the wafer track for 200-mm wafer polishing. A slurry inlet tube from a controllable flow rate pump connected directly to the slurry inlet tube located at segment 1 and slurry inlet tubes at segments 2 to 5 were blocked.

Practice Examples 1-3. After successful preliminary tests of the integrity and stability of the injector using water flow rates between 50 and 300 cc/min and platen rotation rates between 10 and 80 RPM, a polishing test was run as follows. A new DOW IC-1000 k-groove CMP pad was conditioned for 30 minutes with de-ionized water at a platen rotation speed of 20 RPM with a new 3M A2810 conditioning disk on an Araca Incorporated APD-800 polisher at a down force of 13.3 lbf and oscillation frequency of 11 sweeps/min. The slurry used during wafer polishing was Cabot Microelectronic SS25 fumed silica slurry diluted 1:1 with de-ionized water. Two hundred millimeter diameter wafers with a layer of silicon dioxide deposited from a tetraethoxysilane source (known as TEOS wafers) were then polished using a procedure emulating as closely as possible to a proprietary industry process. In APD-800 polisher, the main polishing process includes wafer polishing for 60 sec at polishing pressure of 3.3 PSI and platen/head rotation rates to 30/31 RPM with ex-situ conditioning (conditioning between wafer polishes).

Prior to running wafers to be used for measuring removal rates ("rate wafers"), a used ("dummy") TEOS wafer was processed for several minutes and then a series of 10 TEOS dummies were polished each until the mean coefficient of friction (COF) stabilized. Two TEOS rate wafers were then polished at each of the injector flow rates of 200, 150 and 100 ml/min. A flow rate of 200 ml/min is the standard slurry flow rate. Mean removal rates measured using a reflectometer from two diameter scans of each of the two rate wafers processed at each flow rate were 1655, 1613 and 1551 Angstroms/minute at 200, 150 and 100 cc/min, respectively.

Comparative experiments 1-3. The injector was removed and two rate wafers were polished while slurry was pumped onto the center of the pad (center application) at flow rates of 200, 150 and 100 ml/min. Mean removal rates from a total of 2 diameter scans from each two rate wafers were 1357, 1319 and 1170 Angstroms/minute at 200, 150 and 100 ml/min, respectively. Thus, at every flow rate, the removal rate achieved using the injector exceeded the rate achieved using the standard center application by 22 to 33 percent. Relative to the standard center application procedure run at 200 ml/min, the same removal rate could be achieved with the injector using less than half as much slurry.

Practice Examples 4-6. This is the same as practice examples 1-3 except repeated using a DOW IC-1000 groove-2 CMP pad and having a slurry inlet tubing from a controllable flow rate pump connected to a manifold having 4 slurry outlets which were then connected with 4 Tygon tubes to 4 slurry inlet tubes attached in the injector body at segments 1 to 4. The slurry inlet tube at segment 5 was intentionally blocked. The total slurry flow rate disbursed from 4 slurry outlets in the injector body was the same as the slurry flow rate at the inlet of the manifold. Mean removal rates measured using a reflectometer from two diameter scans of each of the two rate wafers processed at each flow rate were 1338, 1318 and 1236 Angstroms/minute at 200, 150 and 100 ml/min, respectively.

Comparative Experiments 7-9. The injector was removed and two rate wafers were polished while slurry was pumped onto the center of the pad (center application) at flow rates of 200, 150 and 100 ml/min. Mean removal rates from a total of 2 diameter scans from each two rate wafers were 1213, 1168 and 1119 Angstroms/minute at 200, 150 and 100 ml/min, respectively. Thus, at every flow rate, the removal rate achieved using the injector exceeded the rate achieved using the standard center application by 10 to 13 percent. Relative to the standard center application procedure run at 200 ml/min, the same removal rate could be achieved with the injector using about half as much slurry.

DETAILED DESCRIPTIONS OF DRAWING ELEMENTS

FIG. 1 shows a bottom view of injector 110 according to invention.

123 is the injector bottom.

121 is the leading edge of the injector bottom.

122 is the trailing edge of the injector bottom.

125 is the bottom surface of the injector bottom.

131 are the top surface openings, or slurry inlets, for receiving slurry into the injector bottom.

132 is the bottom surface opening, or slit, or slurry outlet trough, through which slurry flows and spreads to the pad surface. Bottom surface opening(s) 132 are in fluid communication with top surface opening(s) 131.

140 is a groove in the bottom surface 125 of injector bottom 123 of injector 110.

Figure 2:
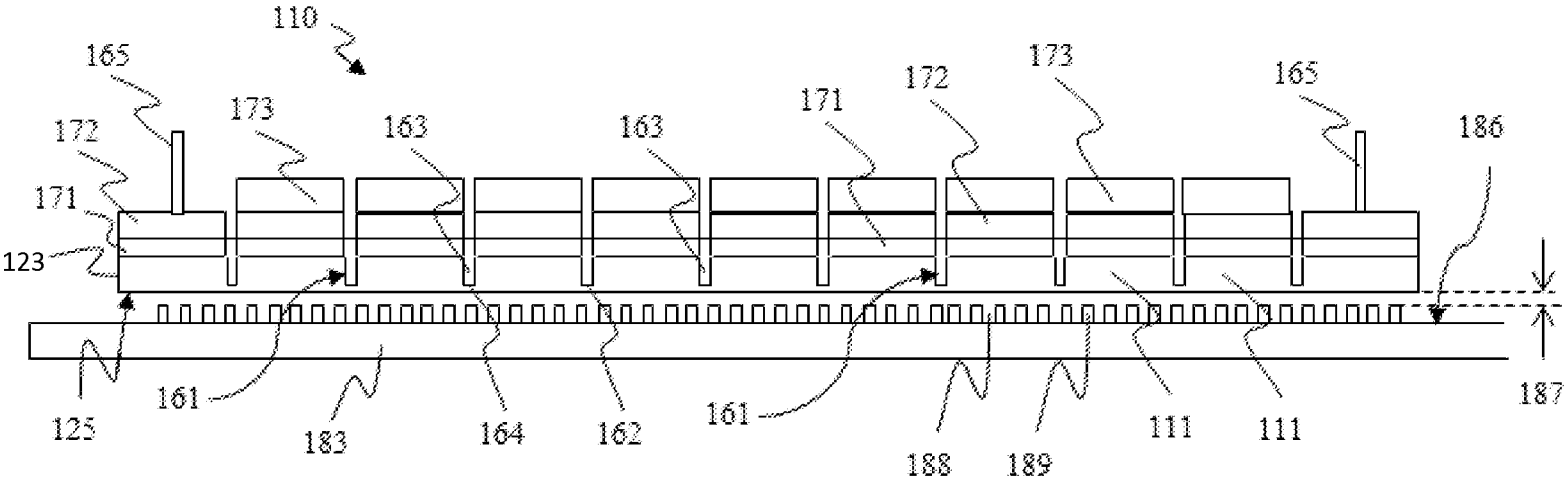
FIG. 2 shows a front view of injector 110.

FIG. 2 shows a front view of injector 110.

111 are the segments of injector bottom 110 between two adjacent slots 161.

125 is the bottom surface of the injector bottom 123, facing the top surface 186 of polishing pad 183 during polishing. In some embodiments bottom surface 125 is resting on top surface 186 of polishing pad 183.

161 are the slots created in the top surface of the injector bottom 123.

162 are the thin material sections of injector bottom 123 as a result of a slot 161.

163 are the fillers located inside the slot 161 and/or in space between two adjacent intermediate layers 171.

164 is the bottom surface of a slot 161.

165 are the injector holders where the rod 191 and/or rod end 192 installed.

171 are the intermediate layers.

172 are the 1$^{st}$ layer of dead weights.

173 are the 2$^{nd}$ layer of dead weights arranged toward the trailing edge 122 of injector 110.

183 is the polishing pad.

186 is the top surface of the polishing pad 183.

187 is the mean gap between the bottom surface 125 of the injector 110 and the polishing pad 183.

188 are the grooves between the land areas 189.

189 are the land areas on the top surface 186 of the polishing pad 183.

Figure 3:
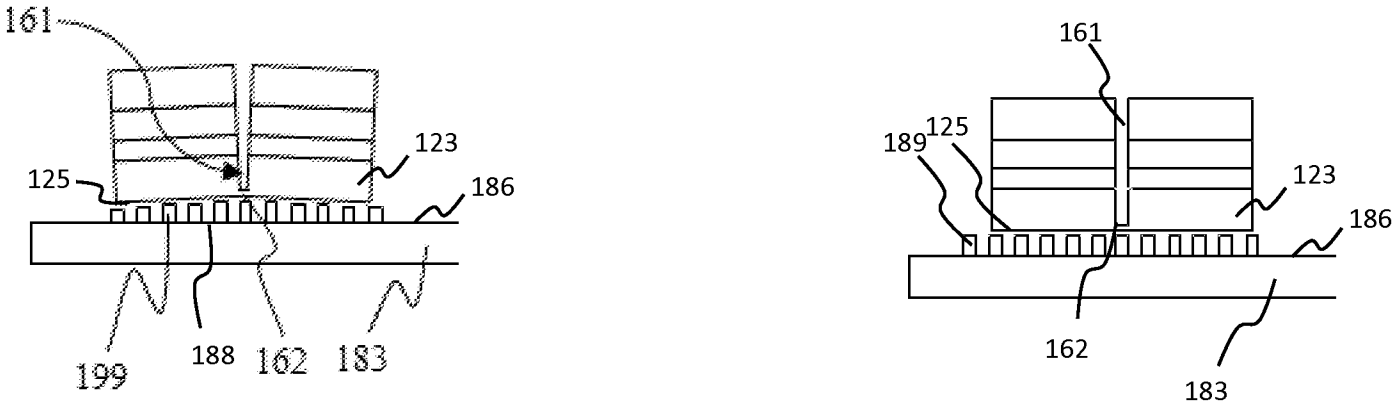
FIG. 3 illustrates how the flexible injector conforms to a non-flat pad surface.

FIG. 3 illustrates how the flexible injector bottom 123 conforms to a non-flat profile of a pad surface 186.

199 are depiction of a worn upper surface pad land area 189 resulting in a non-flat pad macroscopic profile.

Figure 4:
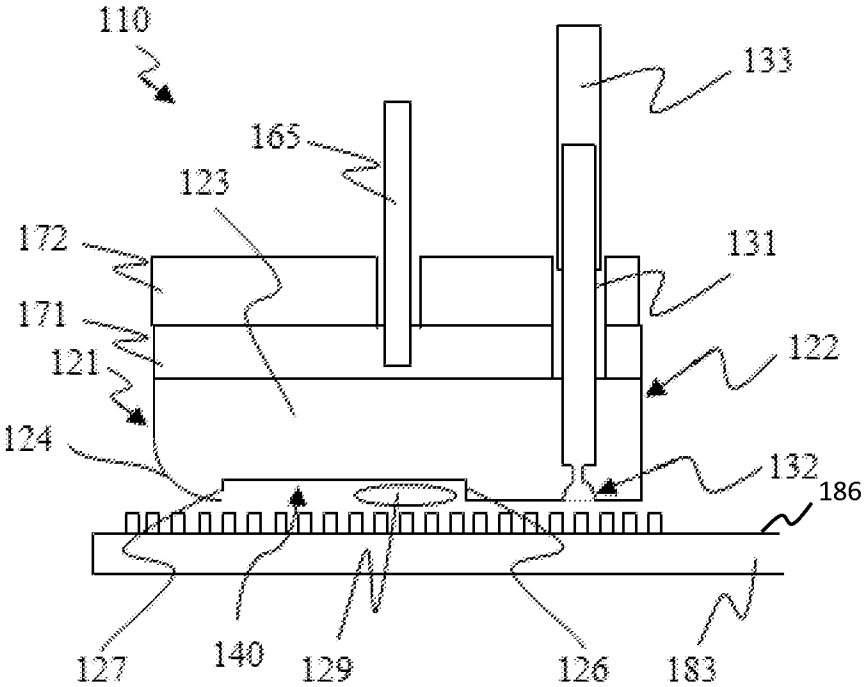
FIG. 4 shows a cross section view of a segment of injector 110 where there is fluid communication with one top surface opening 131, an intermediate layer 171, and a $1^{st}$ layer dead weight 172.

FIG. 4 shows a cross section view of a segment of injector 110 where there is fluid communication with of the one injector top surface openings 131, an intermediate layer 171 and a 1$^{st}$ layer dead weight 172.

124 is the rounded or chamfered edge at the leading edge 121 of the bottom surface 125 of injector bottom 123.

126 is the trailing sidewall of an injector bottom's groove 140.

127 is the leading sidewall of an injector bottom's groove 140.

129 is a bow wave formed in the injector bottom's groove 140 during polishing.

Figure 5:
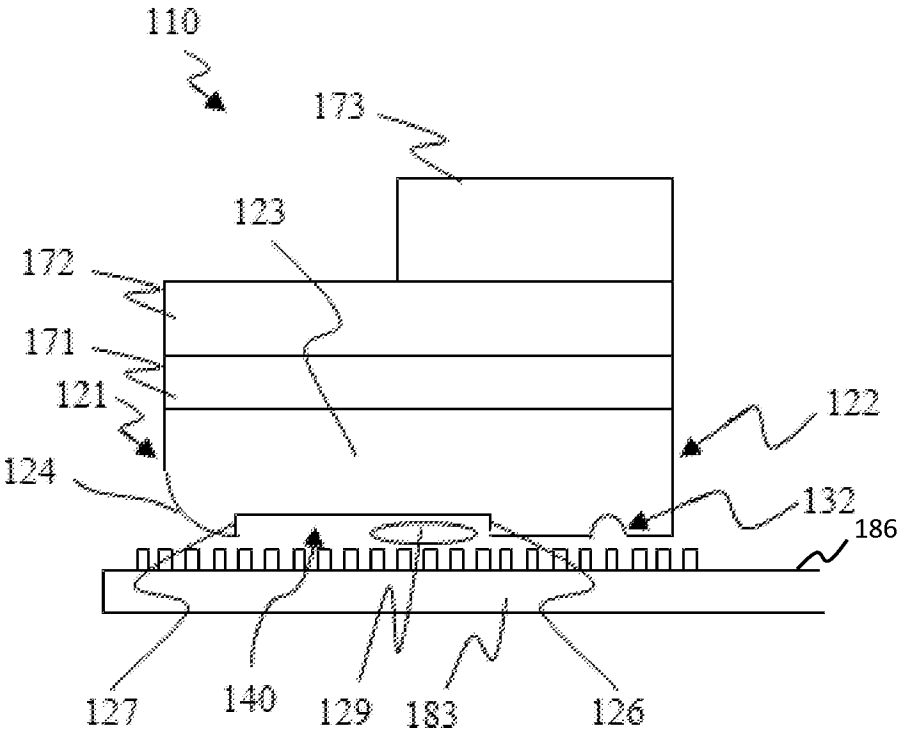
FIG. 5 shows a cross section view of a segment of injector 110 with an intermediate layer 171, a $1^{st}$ layer dead weight 172 and a $2^{nd}$ layer dead weight 173.

133 is a tube trough which CMP slurry or components thereof are introduced through one or more tubes FIG. 5 shows a cross section views on a segment of injector 110 with an intermediate layer 171, a 1$^{st}$ layer dead weight 172 and a 2$^{nd}$ layer dead weight 173.

Figure 6:
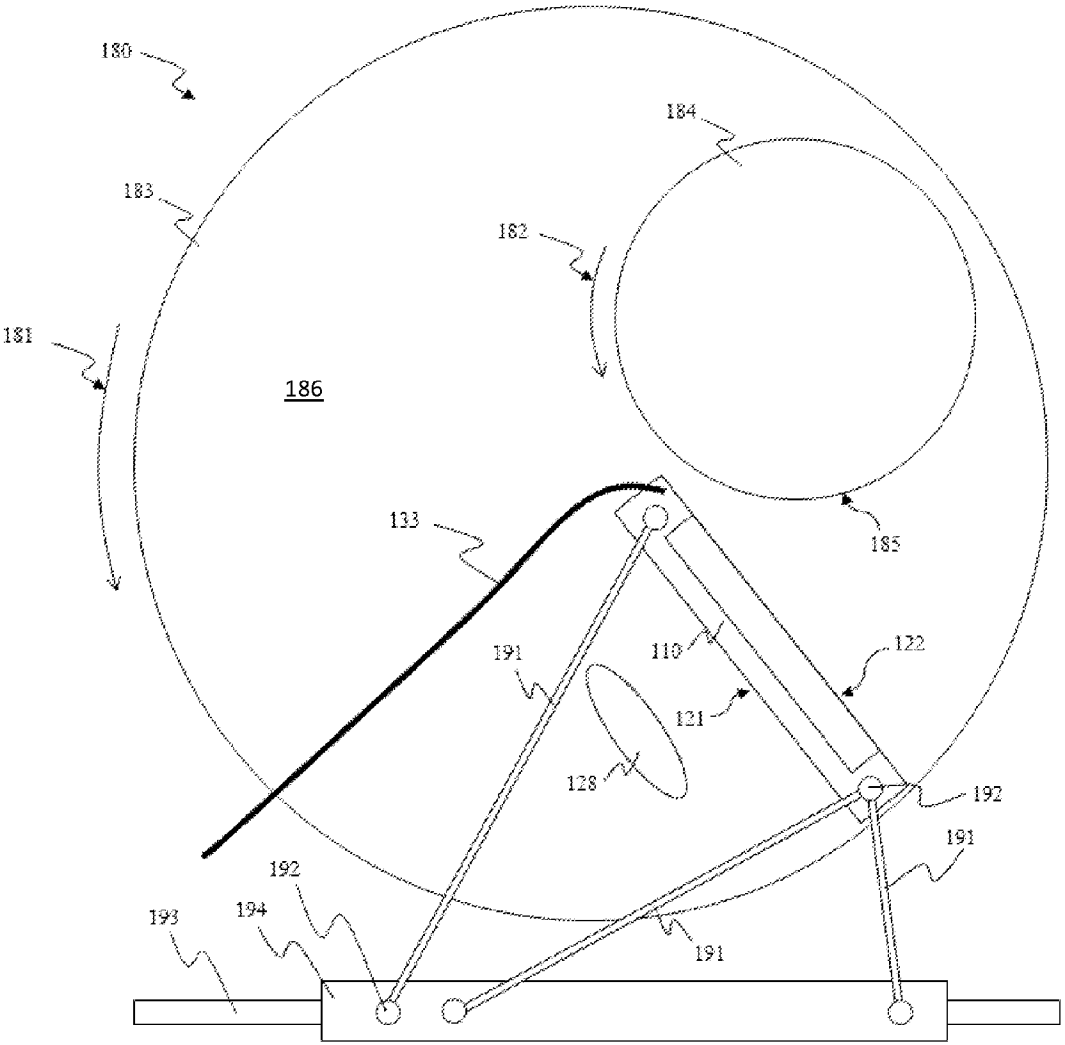
FIG. 6 shows a method of polishing a semiconductor wafer (184) using a slurry injector (110) on a CMP tool (180) according to the invention. The polishing pad rotates in a counter-clockwise (181) direction and the wafer (184) rotates in a counter-clockwise (182) direction as well.

FIG. 6 shows method of polishing a semiconductor wafer 184 using a slurry injector on a CMP tool according to the invention.

128 is the bow wave formed in the leading edge 121 of injector 110 during polishing.

181 is the polishing pad rotating in a counter-clockwise fashion.

182 is the polished substrate rotating in a counter-clockwise fashion.

184 is the polished substrate or wafer.

185 is the leading edge of the polished substrate or wafer.

191 is the rod holding the injector 110 to support mechanism 194

192 is the rod ends

193 is the part of polisher body on which the support mechanism 194 is attached

194 is the support mechanism

The embodiments and examples set forth herein were presented in order to best explain the disclosed invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. An injector device for injecting slurry onto a polishing pad of a chemical mechanical polishing (CMP) tool, the injector device comprising:

an injector bottom, wherein the injector bottom comprises:

a top surface comprising one or more than one top surface opening;

a bottom surface comprising one or more than one bottom surface opening, wherein the one or more than one bottom surface opening is in fluid communication with the one or more than one top surface opening;

a leading edge, wherein the leading edge is chamfered;

a trailing edge;

and a groove formed in the bottom surface, wherein the groove extends along a length of the injector bottom between the leading edge and the trailing edge, and wherein the groove comprises:

a leading sidewall, wherein the leading sidewall extends in a direction parallel to the leading edge;

and a trailing sidewall, wherein the trailing sidewall extends in a direction parallel to the trailing edge;

wherein a CMP slurry introduced through the one or more than one top surface opening travels through the injector bottom and exits the injector device through the one or more than one bottom surface opening onto the polishing pad top surface;

wherein the bottom surface of the injector bottom further comprises a slit extending along the length of the injector bottom between the trailing sidewall and the trailing edge; and wherein the top surface of the injector bottom further comprises a plurality of slots formed in the top surface, wherein the slots run from the leading edge to the trailing edge, and wherein a depth of each of the plurality of slots extends from the top surface of the injector bottom into the injector bottom, and wherein the depth of each of the plurality of slots does not extend all the way to the bottom surface.

2. The injector device of claim 1, wherein the injector bottom is rectilinear shaped.

3. The injector device of claim 2, wherein the bottom surface rests on the polishing pad.

4. An injector device for injecting slurry onto a polishing pad of a chemical mechanical polishing (CMP) tool, the injector device comprising:

a rectilinear shaped injector bottom, wherein the injector bottom comprises:

a top surface comprising one or more than one top surface opening;

a bottom surface comprising one or more than one slit, wherein the one or more than one slit is in fluid communication with the one or more than one top surface opening;

a leading edge;

and a trailing edge; and a first set of weights positioned on top of the top surface;

wherein a CMP slurry introduced through the one or more than one top surface opening travels through the injector bottom and exits the injector device through the one or more than one slit onto the polishing pad top surface.

5. The injector device of claim 4, wherein the bottom surface rests on a top surface of the polishing pad.

6. The injector device of claim 4, wherein the injector device has a center of gravity between the leading edge and the trailing edge, and wherein the distance from the leading edge to the center of gravity is larger than the distance from the center of gravity to the trailing edge.

7. The injector device of claim 4, further comprising a second set of weights positioned on top of the first set of weights.

8. The injector device of claim 4, wherein the top surface of the injector bottom further comprises one or more than one slot formed in the top surface, wherein the one or more than one slot runs from the leading edge to the trailing edge, wherein a depth of each of the one or more than one slot extends into the injector bottom from the top surface, and wherein the depth of each of the one or more than one slot does not extend all the way to the bottom surface.

9. The injector device of claim 4, further comprising a groove formed in the bottom surface running along a length of the injector device, wherein the groove is located between the leading edge and the trailing edge.

10. An injector device for injecting slurry onto a polishing pad of a chemical mechanical polishing (CMP) tool, the injector device comprising:

a rectilinear shaped injector bottom, wherein the injector bottom comprises:

a top surface comprising one or more than one top surface opening;

a bottom surface comprising one or more than one bottom surface opening, wherein the one or more than one bottom surface opening is in fluid communication with the one or more than one top surface opening;

a leading edge;

a trailing edge;

and one or more than one slot formed in the top surface, wherein a depth of each of the one or more than one slots extends from the top surface into the injector bottom, and wherein the depth of each of the one or more than one slots does not extend to the bottom surface;

wherein a CMP slurry introduced through the one or more than one top surface opening travels through the injector bottom and exits the injector device through the one or more than one bottom surface opening onto the polishing pad top surface.

11. The injector device of claim 10, wherein the bottom surface rests on a top surface of the polishing pad.

12. The injector device of claim 10, wherein the one or more than one bottom surface opening forms a slit in the bottom surface.

13. The injector device of claim 12, wherein the slit runs parallel to the injector trailing edge.

14. The injector device of claim 10, wherein the leading edge is straight, and wherein the trailing edge is straight.

15. The injector device of claim 10, further comprising a groove formed in the bottom surface running along the length of the injector bottom, wherein the groove is located between the leading edge and the trailing edge.

* * * * *